US005794199A

United States Patent [19]

Rao et al.

[11] Patent Number: 5,794,199

[45] Date of Patent: Aug. 11, 1998

[54] METHOD AND SYSTEM FOR IMPROVED DISCONTINUOUS SPEECH TRANSMISSION

[75] Inventors: Ajit V. Rao, Goleta, Calif.; Wilfrid P. LeBlanc, Dallas, Tex.

[73] Assignee: Texas Instruments Incorporated, Dallas, Tex.

[21] Appl. No.: 593,206

[22] Filed: Jan. 29, 1996

[51] Int. Cl.[6] ..... G10L 5/02

[52] U.S. Cl. ..... 704/258; 704/226; 704/262; 704/264

[58] Field of Search ..... 395/2.35, 2.37, 395/2.42, 2.67, 2.71–2.73, 2.28–2.32, 2.24; 704/219–223, 215, 226–228, 233, 258, 262–265

[56] References Cited

U.S. PATENT DOCUMENTS

| | | | |
|---|---|---|---|
| 4,771,465 | 9/1988 | Bronson et al. | 381/36 |
| 4,797,926 | 1/1989 | Bronson et al. | 381/36 |
| 4,899,385 | 2/1990 | Ketchum et al. | 381/36 |
| 4,910,781 | 3/1990 | Ketchum et al. | 381/36 |
| 5,091,945 | 2/1992 | Kleijn | 381/36 |
| 5,267,317 | 11/1993 | Kleijn | 381/38 |
| 5,475,712 | 12/1995 | Sasaki | 395/2.28 |
| 5,537,509 | 7/1996 | Swaminathan et al. | 395/2.32 |
| 5,539,858 | 7/1996 | Sasaki et al. | 395/2.35 |
| 5,553,192 | 9/1996 | Hayata | 395/2.28 |
| 5,630,016 | 5/1997 | Swaminathan et al. | 395/2.32 |

OTHER PUBLICATIONS

W.B. Kleijn, et al., "Fast Methods for the CELP Speech Coding Algorithm", IEEE Transactions on Acoustics Speech and Signal Processing, vol. 38, No. 8, Aug. 1990, pp. 1330–1342.

W.B. Kleijn, et al., "An Efficient Stochastically Excited Linear Predictive Coding Algorithm for High Quality Low Bit Rate Transmission of Speech", Speech Communication, vol. 7, No. 3, Elsevier Science Publishers B.V. (North–Holland), 1988, pp. 305–316.

W.B. Kleijn, et al., "Improved Speech Quality and Efficient Vector Quantization in SELP", IEEE, International Conference on Acoustics, Speech, and Signal Processing, Apr. 1988, New york, USA, pp. 155–158.

*Primary Examiner*—Kee M. Tung

*Attorney, Agent, or Firm*—Tammy L. Williams; Robert L. Troike; Richard L. Donaldson

[57] ABSTRACT

To overcome the problem of poor representation of the background noise, the present invention includes a noise parameter generator (40) which uses a weighted average of auto-correlation values of the input signal generated during the noise-analysis phase. The weighting function gives less weight to the auto-correlations during the first few frames (as they may contain speech) and more weight to frames towards the end of this phase. Also included, to overcome the bursty nature of comfort noise, is a comfort noise generator (50) which gradually changes the nature of the signal from speech to pseudo-random noise after the speech-burst. The comfort noise generator (50) of the present invention excites the auto-regressive filter corresponding to the noise model with a weighted combination of the past excitation and pseudo-random noise.

6 Claims, 4 Drawing Sheets

METHOD AND SYSTEM FOR IMPROVED DISCONTINUOUS SPEECH TRANSMISSION

TECHNICAL FIELD OF THE INVENTION

This invention relates generally to speech processing and in particular to a method and system for providing improved discontinuous speech transmission.

BACKGROUND OF THE INVENTION

The digital transmission of speech occurs in many applications including numerous telephone applications. In telephone applications such as mobile communication systems, low power consumption is crucial to longer battery life-time and, consequently, to better performance. In cellular telephones, for example, by switching off the transmitter between bursts of speech, power can be conserved. In an end-to-end telephone conversation, each user typically speaks about 40–60% of the time. Between these bursts of speech, the transmitter is simply being used to send background noise to the receiver.

By efficiently detecting voice activity, switching off the transmitter when no voice is present, and using a perceptually acceptable method of filling in the gaps between the speech bursts, the lifetime of the battery can be approximately doubled at little additional cost. This technique, known as discontinuous transmission, also eases packet traffic in typical Code-Division Multiple Access (CDMA) and Time Division Multiple Access (TDMA) communication systems, allowing more subscribers to use the network with less interference. FIG. 1 shows a exemplary vocoder 10 used in such communication systems. The vocoder 10 includes an encoder 12 which processes data for transmission over output channel 16 and a decoder 14 which processes incoming communications from input channel 18.

The encoder 12 is shown in more detail in FIG. 2. The exemplary encoder 12 shown in FIG. 2 includes a control module 20, a voice activity detector (VAD) 22, a speech parameter generator 12 and a noise parameter generator 26. The decoder 14 is shown in more detail in FIG. 3 and includes a control module 30, a speech parameter detector 32, a speech generator 34 and a comfort noise generator 36.

An important component in the encoder 12 of a discontinuous transmission system is the VAD 22 which detects pauses in speech so that no transmission of data occurs during periods of no voice activity. The VAD 22 must be able to detect the absence of speech in a signal, as much as possible, while not mis-classifying speech as noise even in poor Signal-To-Noise (SNR) conditions. A primary problem, however with systems which use the VAD 22 is clipping of initial parts of the detected speech. This occurs in part because speech transmission is not resumed until after speech activity has been detected. Another problem is the lack of background noise during inactivity which would normally occur in a continuous transmission system.

In an attempt to improve the quality of synthesized speech generated by the speech generator 34 in systems which use the VAD 22 to reduce data transmissions, synthesized comfort noise, generated by the comfort noise generator 36, is added during the decoding process performed by the decoder 18 to fill in the gaps between the bursts of speech. The synthesized comfort noise, however, does not model actual background noise experienced at the encoder 12 thus, any quality improvements are minimal.

Some techniques to capture and inform the speech decoder 18 of the actual nature of the background noise have been proposed in the prior art.

In typical speech compression schemes like Code-Excited Linear Prediction (CELP) [see M. R. Schroeder and B. S. Atal, "Code-excited linear prediction (CELP): High quality speech at very low bit rates", Proc. Inter. Conf. Acoust., Speech, Signal Processing, 1985, pp. 937–940, vol. 1.], the digitally sampled input speech received through input channel 16 is divided into non-overlapping frames for the purpose of analysis. The VAD 22 then classifies each frame as being either speech or noise.

To synthetically generate a noise similar to the background noise, a common approach in such systems is to then capture the statistics of this noise and to generate a statistically similar pseudo-random noise at the decoder 30. A common model for background noise is a low-order auto-regressive process. An advantage of this model is its similarity to the model often used for regular speech. This similarity allows the use of similar quantization schemes to compress the short-term parameters of both noise and speech in the noise parameter generator 26 and in the speech parameter generator 24, respectively. The auto-regressive model can then be deduced from the short-term auto-correlation values of the noise process.

In many discontinuous transmission schemes, the first few frames classified as noise are re-classified as "noise-analysis frames." During these frames, the noise is coded as regular speech, however, the auto-correlation values computed during the analysis of these frames are averaged to compute the auto-correlation of the noise. If more noise frames follow the noise analysis frames, these auto-correlation values are used to infer the decoder 18 before the transmitter is switched off.

This approach has been used by the Groupe Speciale Mobile (GSM) of the European Telecommunications Standards Institute (ESTI) in both the full-rate [see European Telecommunications Standards Institute (ESTI), European Digital Cellular Telecommunication System (Phase 2); Voice Activity Detection (VAD) (GSM 06.32)] and the half-rate [see European Telecommunications Standards Institute (ESTI), European Digital Cellular Telecommunication System; Half-rate Speech Part 6: Voice Activity Detection (VAD) for half rate speech traffic channels (GSM 06.42)] standards.

The VAD 22 which distinguishes noise from speech, however, is usually inaccurate and, furthermore, it is reasonable to expect the first few noise analysis frames to contain a few milli-seconds of speech. Thus, by uniformly averaging, the auto-correlation parameters obtained do not accurately represent the statistics of the actual background noise. The result is often annoying noise between bursts of speech.

Further, in typical discontinuous transmission schemes, the decoder 14 fills in the gaps between speech bursts by simply creating an auto-regressive noise whose statistics match those of background noise. This approach is used in both the GSM full-rate [see European Telecommunications Standards Institute (ESTI), European Digital Cellular Telecommunication System; (Phase 2) Part 4: Comfort Noise aspects for the full rate speech traffic channel (GSM 06.12)] and half-rate [see European Telecommunications Standards Institute (ESTI), European Digital Cellular Telecommunication System; Comfort Noise aspects for the half rate speech traffic channels (GSM 06.22)] standards. This results in noise bursts which do not smoothly blend in with the background noise present when the speakers are active.

SUMMARY OF THE INVENTION

Typical speech compression schemes are made more efficient by using fewer bits when the speaker is silent and only background noise is present. During these intervals, instead of a decoder which merely generates a pseudo-random "comfort noise" with the same statistics as the background noise, the present invention provides a decoder which uses a novel weighted-average method for estimating statistics of the background noise. This method represents the actual background noise better than a un-weighted approach. Further, a novel "smooth-transition" technique which gradually introduces comfort noise between bursts of speech is presented. The smoother transition between speech and comfort noise results in speech which is perceptually more pleasing than that produced by existing methods.

BRIEF DESCRIPTION OF THE DRAWINGS

For a better understanding of the present invention, reference may be made to the accompanying drawings, in which.

DETAILED DESCRIPTION OF THE INVENTION

Figure 1:
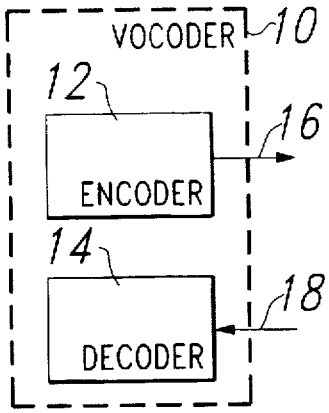
Fig.1 PRIOR ART
FIG. 1 is an exemplary vocoder used in transmission systems of the prior art.
Figure 2:
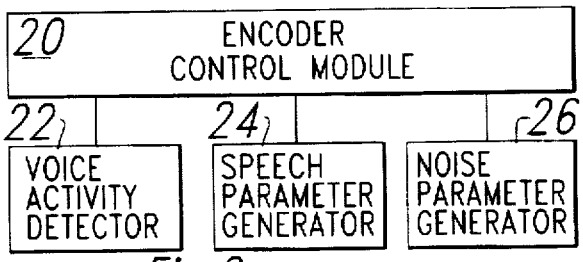
Fig.2 PRIOR ART
FIG. 2 shows an exemplary encoder used in communication systems of the prior art.
Figure 3:
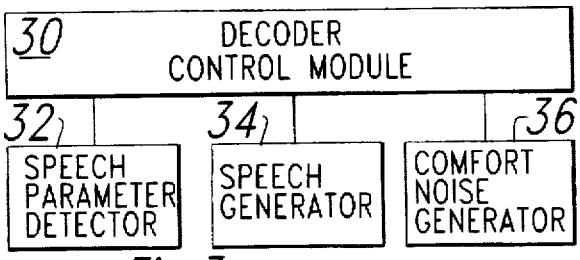
Fig.3 PRIOR ART
FIG. 3 illustrates an exemplary decoder used in communication systems of the prior art.
Figure 4:
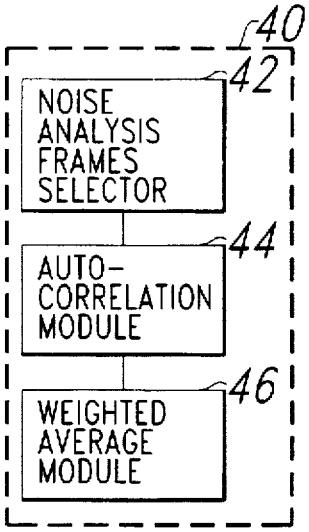
FIG. 4 depicts a noise parameter generator in accordance with the present invention.

To overcome the problem of poor representation of the background noise, FIG. 4 illustrates a noise parameter generator 40 in accordance with the present invention which uses a weighted average of the auto-correlation values of the input signal generated during the noise-analysis phase. A good weighting function gives less weight to the auto-correlations during the first few frames (as they may contain speech) and more weight to frames towards the end of this phase.

Figure 5:
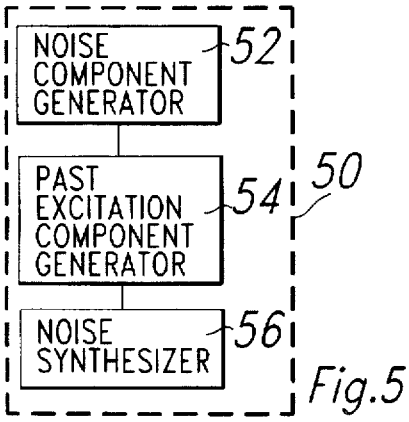
FIG. 5 shows a comfort noise generator in accordance with the present invention.
Figure 6:
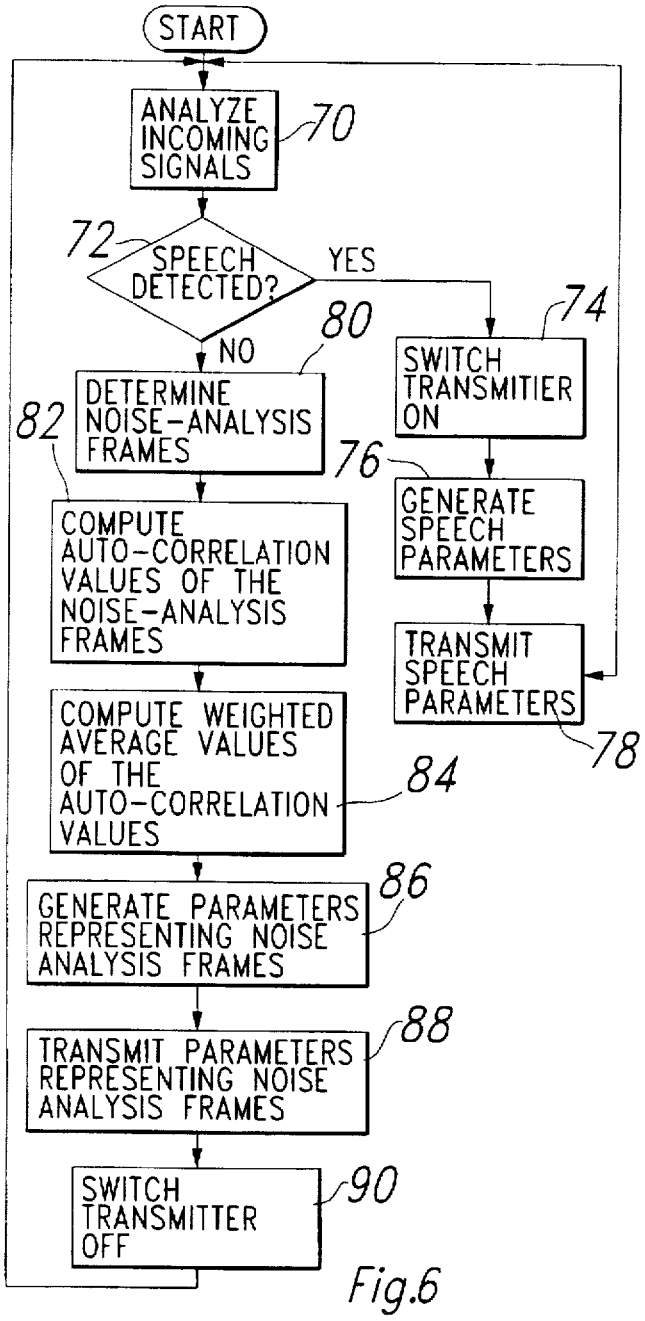
FIG. 6 is a flow chart illustrating the operation of the noise parameter generator in accordance with the present invention.
Figure 7:
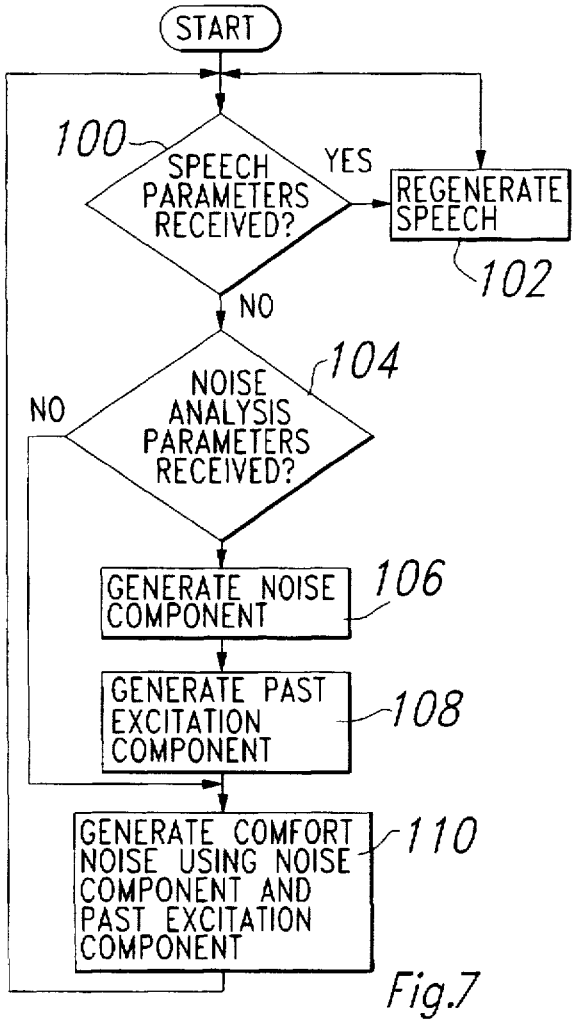
FIG. 7 is a flow chart depicting the operation of the comfort noise generator in accordance with the present invention.

Furthermore, to overcome the bursty nature of comfort noise, FIG. 5 shows a comfort noise generator 50 in accordance with the present invention which gradually changes the nature of the signal from speech to pseudo-random noise after the speech-burst. The approach used in the comfort noise generator 50 of the present invention excites the auto-regressive filter corresponding to the noise model with a weighted combination of the past excitation and pseudo-random noise. This approach gradually changes the energy and character of the comfort noise, making it perceptually pleasing.

In the present invention, a speech coder implementing GSM Enhanced full-rate standard is used although it is contemplated that other coders may also be used. In the speech coder used in the present invention, speech is segmented into non-overlapping frames of 10 ms (80 samples) each. A Voice Activity Detection (VAD) scheme similar to the one used in the GSM half-rate standard is employed to classify speech and noise.

In accordance with the noise parameter generator 40 of the present invention, the first sixteen (16) noisy frames in a burst of noise are re-classified as "noise-analysis" frames in noise analysis frames selector 42. In each such frame, i, auto-correlation module 44 uses the speech samples, $s_i(0)$, $s_i(1)$, . . . , $s_i(79)$, to compute the auto-correlation values, $r_i[j]$, as follows $$r_i[j] = \sum_{n=j}^{79} s_i(n)*s_i(n-j)$$

where j=0, . . . , 8 and i=1, . . . , 16.

Weighted average module 46 then computes the auto-correlation of the background noise, R[j], as weighted average values of the auto-correlation values of the noise-analysis frames computed by the auto-correlation module 44 in accordance with the equation $$R[j] = \frac{\sum_{i=1}^{16} r_i[j]\omega_j}{\sum_{i=1}^{16} \omega_j}$$

where j=0, . . . , 8. In practice, the exponential weighting function $\omega_j$, where $\omega_j=0.8^j$, is used. The weighted average values computed in the weighted average module 46 are then transmitted as noise parameters across the output communications channel 18 and the transmitter is then switched off.

The speech parameters and the noise parameters are received by the decoder also attached to the output communications channel 16. The speech parameters are used in a speech model in the receiving decoder to synthesize the speech represented. A noise model in the receiving decoder uses the noise parameters generated by the transmitting encoder to generate comfort noise which more closely represents the background noise present at the time the speech occurred.

At the decoder, comfort noise generator 40 in accordance with the present invention interleaves the pseudo-random noise more carefully between bursts of speech. In the GSM full- and half-rate standards of the prior art, comfort noise is generated by exciting an 8th order linear auto-regressive filter with white Gaussian noise of a particular energy. However, as mentioned hereinabove, this technique tends to produce bursts of noise which do not blend well with the background noise present when the speaker is active. This is due to two reasons. First, the character of the excitation signal changes suddenly to white Gaussian noise. Second, the energy of the excitation signals changes suddenly to the noise excitation energy.

The comfort noise generator 40 in accordance with the present invention instead gradually changes the energy and character of the excitation signal to that of the pseudo-random noise. This is done by using an excitation signal that has both a pseudo-random white Gaussian noise component, generated by Gaussian noise component generator 52, and a component that depends on the filter excitation during the frame segments which preceded the noise, generated by codebook component generator 54. This approach does not involve any additional memory in CELP-based speech coding systems since past excitations are usually stored as a adaptive codebook.

The component of the noise excitation generated by the codebook component generator 54 which depends on the past excitations is simply a randomly delayed segment of the adaptive codebook or, more generally, a randomly delayed segment of past excitations. Randomly delaying the adaptive codebook contribution in each sub-frame of the noise excitation is important to avoid tonality to the comfort noise. Further, the weighting given to the adaptive codebook contribution of the noise excitation is gradually reduced with time, as discussed hereinbelow. This ensures even lesser tonality and, as a result, within a few sub-frames, the noise excitation is almost completely white.

As an example, suppose that at the end of a typical speech burst the noise analysis frames end in frame k and frames k+1, k+2, . . . , k+N were classified as noisy frames. Further, suppose each noisy frame, i, is divided into two sub-frames represented by the pairs (i, 1) and (i, 2).

The synthetic speech, $\hat{s}(i, j)[n]$, in each noisy sub-frame (i, j) is generated by feeding an excitation signal, $e_{ij}(n)$, to an 8th order auto-regressive filter with coefficients, a[0]=1.0, a[1], . . . , a[8]. The filter performs the following operation:

$$\hat{s}_{(i,j)} = -\sum_{k=0}^{8} a[k]\hat{s}_{(i,j)}[n-k] + e_{i,j}(n)$$

where n=1, 2, . . . , 40; i=(k+1), . . . , N; and where j=1, 2.

In the GSM standard, the excitation e(n) is the white Gaussian noise $$e_{i,j}^{GSM}(n)=N(i,\sigma^2).$$

In the present invention, e(n), as generated by the Gaussian noise component generator 52 and the codebook component generator 54, is the weighted sum $$e_{i,j}(n)=(1-f_i)N(o,\sigma^2)+f_i d(n-1_{(i,j)}).$$

Here, $1_{(i,j)}$ is simply a uniformly distributed random number whose range depends on the memory of the adaptive codebook used. Further, the weighting factor, f, is gradually reduced as i increases. In simulations using the present invention, $f_i=0.95^i$ worked well.

The combination of both the weighted average noise estimation and the noise reconstruction aspects of the present invention greatly improve the quality of the speech coder being tested.

Although the present invention has been described in detail, it should be understood that various changes, substitutions and alterations can be made thereto without departing from the spirit and scope of the present invention as defined by the appended claims.

What is claimed is:

1. A method of generating comfort noise to interleave between bursts of speech in a speech synthesizer, comprising the steps of:

providing an 8th order auto-regressive filter $$\hat{s}_{(i,j)} = -\sum_{k=0}^{8} a[k]\hat{s}_{(i,j)}[n-k] + e_{i,j}(n)$$

where n=1, 2, . . . , 40; i=(k+1), . . . , N; and where j=1, 2, . . . , 40;

feeding a first excitation signal, $e_{i,j}(n)$, to the 8th order auto-regressive filter with coefficients a[0]=1.0, a[1], . . . , a[8] to generate a synthetic speech component, $\hat{s}(i, j)[n]$ in each noisy subframe (i, j); and generating a second excitation signal which includes both a pseudo-random noise component and a component which depends upon past excitations, wherein said component which depends upon past excitations is the synthetic speech component, $\hat{s}(i, j)[n]$.

2. The method of claim 1 wherein said pseudo-random noise component is white Gaussian noise.

3. The method of claim 1 wherein said synthetic speech component is a randomly delayed segment of an adaptive codebook.

4. The method of claim 1 wherein a weighting is given to said synthetic speech component and wherein said weighting is reduced over time.

5. The method of claim 1 wherein each of said first and second excitation signals, $e_{i,j}(n)$, is a weighted sum $$e_{i,j}(n)=(1-f_i)N(0,\sigma^2)+f_i d(n-1_{(i,j)})$$

where $1_{(i,j)}$ is a uniformly distributed random number whose range depends on the memory of said adaptive codebook and where f, is a weighting factor.

6. The method of claim 5 wherein said weighting factor, f, is $f_i=0.95^i$.

* * * * *